US009802302B1

(12) United States Patent
Colson

(10) Patent No.: US 9,802,302 B1
(45) Date of Patent: Oct. 31, 2017

(54) UNIVERSAL ROTATING SCROLL PULLER

(71) Applicant: Fredrick Theodore Colson, Clearwater, FL (US)

(72) Inventor: Fredrick Theodore Colson, Clearwater, FL (US)

(73) Assignee: Fredrick Theodore Colson, Clearwater, FL (US)

( * ) Notice: Subject to any disclaimer, the term of this patent is extended or adjusted under 35 U.S.C. 154(b) by 20 days.

(21) Appl. No.: 15/091,508

(22) Filed: Apr. 5, 2016

Related U.S. Application Data

(60) Provisional application No. 62/178,257, filed on Apr. 6, 2015.

(51) Int. Cl.
*B25B 27/06* (2006.01)
*B25B 27/00* (2006.01)

(52) U.S. Cl.
CPC ..... *B25B 27/062* (2013.01); *B25B 27/0035* (2013.01)

(58) Field of Classification Search
None
See application file for complete search history.

(56) References Cited

U.S. PATENT DOCUMENTS 4,630,501 A * 12/1986 Kubota ..... B60R 16/027 180/78
5,224,254 A * 7/1993 McPeak ..... B25B 27/023 29/261
5,557,833 A * 9/1996 Pool ..... B25B 27/023 29/261
2009/0235785 A1* 9/2009 Kim ..... F16H 25/18 81/57.33
2012/0151735 A1* 6/2012 Thomas ..... B25B 27/062 29/426.5

* cited by examiner

*Primary Examiner* — Joseph J Hail
*Assistant Examiner* — Brian Keller

(57) ABSTRACT

The Universal Rotating Scroll Puller is a new and improved tool for application with automotive, commercial, marine, and industrial remanufacturing. This puller has several advantages. It is fast and easy to use, has good gripping force, is self-centering, adjustable to many different sizes, and can pull a wide variety of mounted objects. Some applications include bearings, V-groove and serpentine pulleys, and alternator frames of various shapes, sizes and locations. Varieties of finger sets are available for multiple applications and extractions. The number of fingers sets can vary from as few as two fingers to as many as six, but most commonly, this puller uses six fingers that can move radially inward or outward by means of a flat scroll plate that is turned about a central axis in order to maneuver the self-centering fingers.

5 Claims, 7 Drawing Sheets

UNIVERSAL ROTATING SCROLL PULLER

CROSS-REFERENCE TO RELATED APPLICATIONS

This application claims priority to U.S. Provisional Application Ser. No. 62/178,257, Confirmation No. 4914 Filed Apr. 6, 2015 by Fred T. Colson, entitled "Universal Rotating Scroll Puller"

STATEMENT REGARDING FEDERALLY SPONSORED RESEARCH OR DEVELOPMENT

Not Applicable

REFERENCE TO SEQUENCE LISTING, TABLE, OR A COMPUTER PROGRAM LISTING COMPACT DISC APPENDIX

Not Applicable

BACKGROUND OF INVENTION

Field of the Invention

This invention pertains to useful improvements to a bearing puller and is particularly adapted for removal of alternator frames, pulleys (both V-groove and serpentine) and bearings.

Description of Prior Art

Bearings are typically press-fit onto shafts by machines, making it very difficult for a repair person to remove a worn bearing from a shaft. Environmental effects, such as corrosion, also make it very difficult to remove pulleys and frames from automotive alternators. The present invention is able to expand inward or outward with straight vertical jaw fingers that can be locked in that position. It is light enough to be held by hand and twisted bilateral to fit the many different frames to be pulled. This invention evenly applies pressure during removal. This even distribution of force is important for salvaging reusable alternator frames and components during the remanufacturing process for economic reasons.

Accordingly, inventors have developed numerous tools having utility as bearing pullers. Of course, many pullers do not remove bearings from shafts at all, but are used to pull apart items that are not mounted on shafts, but in tight press-fit situations. And there are many variations of these principles, with tools being adapted to fit differing shafts, bearings, pulleys, and gears.

U.S. Pat. No. 1,394,129, Oct. 18, 1921, A. R. Wickersham (Gear Puller). This tool consists of a circular plate with slots and a central threaded opening through which an elongated threaded bolt with a tapered point contacts the shaft. The fingers are located in slots. The main plate utilizes two slots with fingers for manual rotation. The same principle applies where the bolt screws through the disk and bears against the shaft and pushes the shaft from the gear. This tool is the closest example of a puller using fingers in a straight application to remove a mounted frame.

U.S. Pat. No. 9,272,403 B2, Mar. 1, 2016, Da-Tan Liu (Adjustable Dismantling Tool for Annular Member). This is an adjustable dismantling tool for round or ring-shaped (annular) members. It consists of a handle with opposing ends with an axial passing through both ends. This tool is designed to install bearings, a much needed tool in the remanufacturing industries. It is not a puller, but serves to open and close to the adjusted bearing size.

U.S. Pat. No. 5,557,833, Sep. 24, 1996, Pool (Puller Device). This puller has a two yoke system for holding multiple jaw members (fingers) for adjusting the diameter size. It also locks the fingers into the object being pulled for a determined size. The puller fingers have a slight taper and have large grippers (lip, tooth, or flange) on the bottom. This would be problematic removing alternator frames with smaller holes. This puller cannot pull bilaterally which would not let the fingers pull from bearing webs. This is a useful puller for bearings, gears and other such devices.

OTHER REFERENCES SITED

U.S. Pat. No. 6,916,026 B2, Jul. 12, 2005, Meza
U.S. Pat. No. 7,661,182 B2, Feb. 16, 2010, Cantrell
U.S. Pat. No. 6,246,217 B1, Jun. 19, 2001, Kilgore
U.S. Pat. No. 5,174,005 A, Dec. 19, 1992, Somerville
U.S. Pat. No. 5,224,254, Jul. 6, 1993, McPeak

BRIEF SUMMARY OF THE INVENTION

This tool is purposed for use in the remanufacturing of alternators and other remanufactured automotive products, with tight fit applications and odd configurations to be removed from shafts. Briefly, this present invention is comprised of a mechanical apparatus and devices which are designed to achieve one or more of the following pulls: (a) an inside adjusted pull upon an item mounted to a member, or (b) an outside adjusted pull upon an item mounted to a member, (c) a bilateral pull mounted on a member, or (d) a radially adjusted movement to expand and contract the size of the pulling radius by finger members that rotate in four different directions.

DETAILED DESCRIPTION OF THE INVENTION

Figure 1:
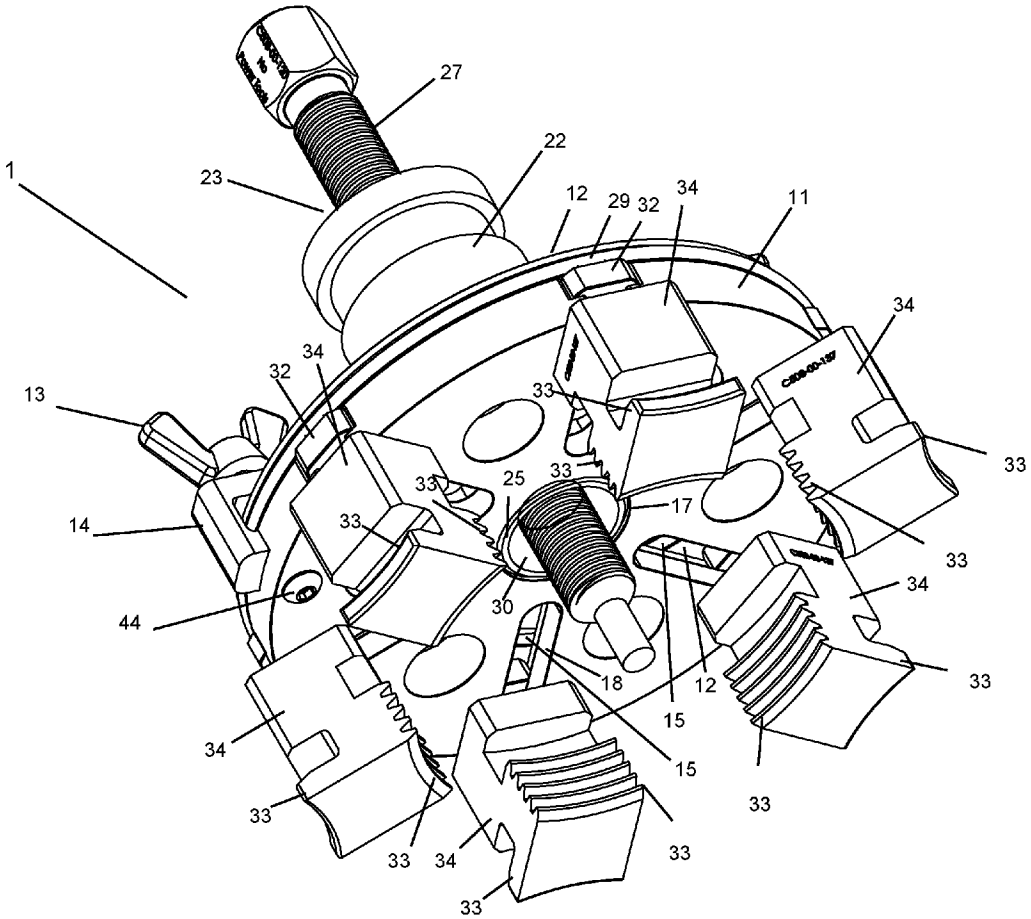
FIG. 1 is a top plan view of the invention noted as a whole assembly
Figure 2:
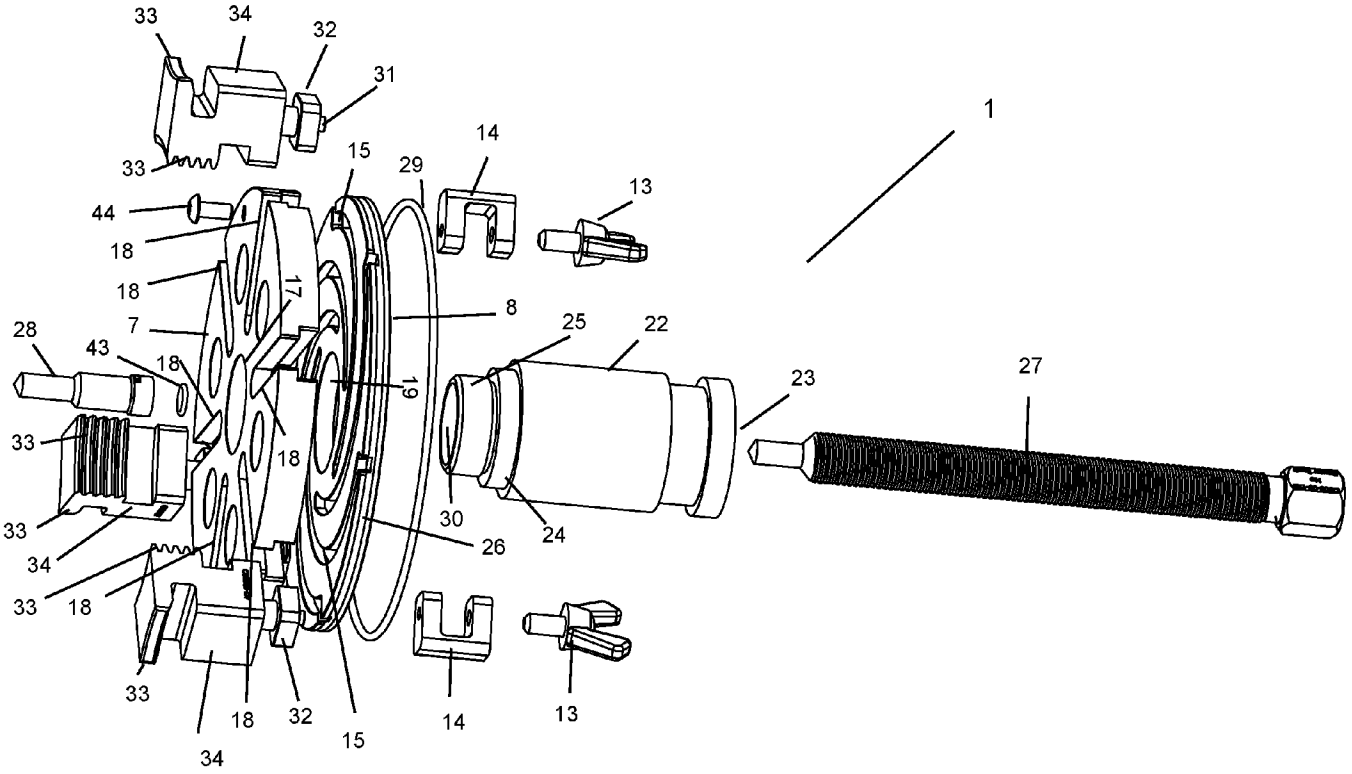
FIG. 2 is an exploded view perspective
Figure 3:
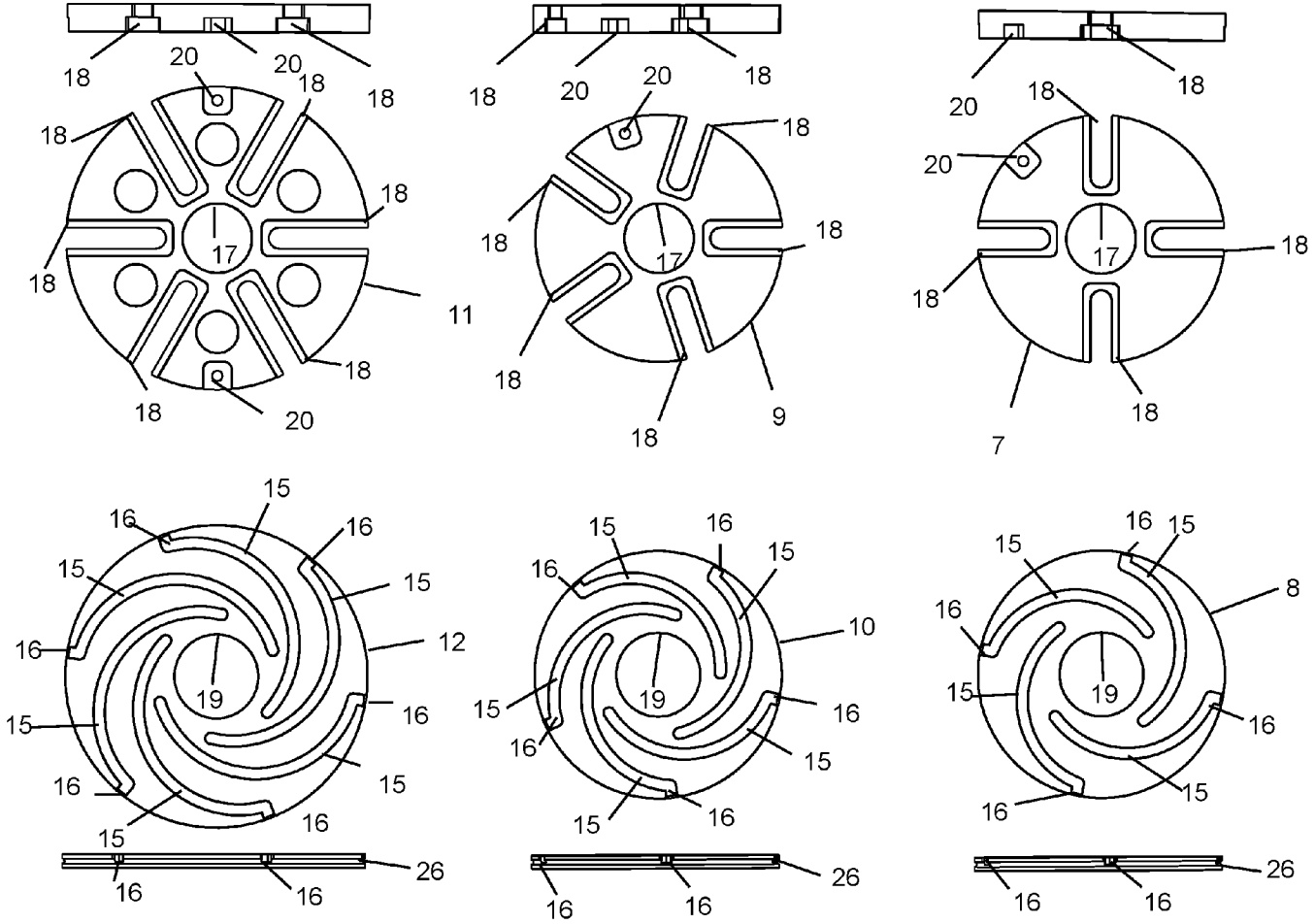
FIG. 3 is a presentation of the three sets of slotted disks
Figure 4:
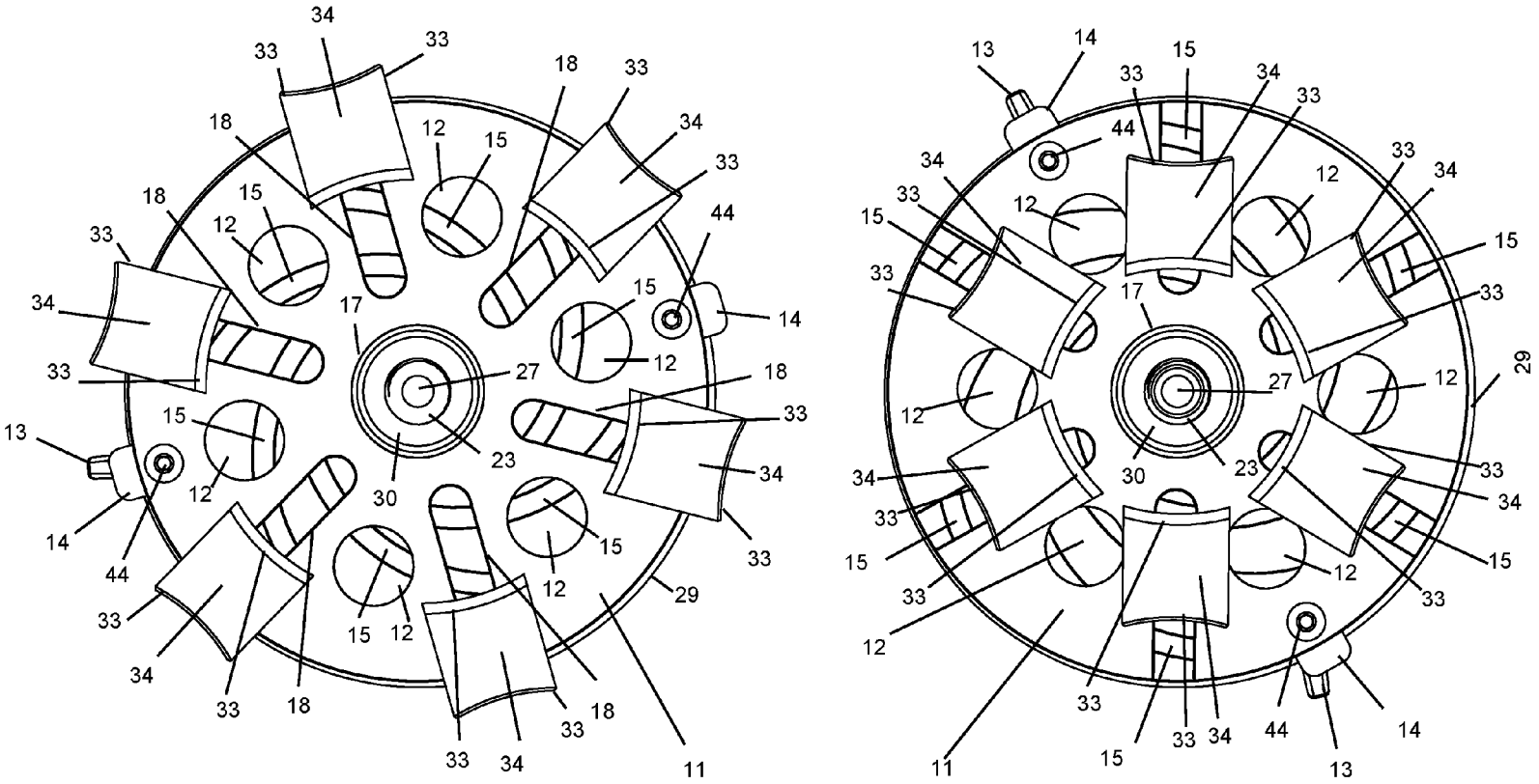
FIG. 4 is a bottom view perspective of the puller in operation

Referring to FIG. 1, the puller 1 consists of a hollow-center 30 master sleeve 22, three master slotted disks 7, 9, 11 with a threaded center bore 17 and matching scroll location plates 8, 10, 12. The master slotted disks 7, 9, 11 and scroll location plates 8, 10, 12 are held together with the master sleeve 22 and locked with a U-shaped clamp 14, attached by a screw 44, and wing screw 13. On the master slotted disk 7, 9, 11 is a slot 20 to attach the U-shaped clamp 14 in order to lock the scroll location plate and master slotted disk, once the fingers 34, 35, 36, 37, 38, 39, 40, 41 are positioned for extractions. The master slotted disk 7, 9, 11 has multiple T-slots 18 for the fingers 34, 35, 36, 37, 38, 39, 40, 41 to glide inward and outward. At the top of each finger 34, 35, 36, 37, 38, 39, 40, 41 is a cylindrical retention pin 31, below the cylindrical retention pin 31 is a four-sided squared-shouldered guide 32. At the bottom of each finger is a unique flange 33. The matching scroll location plates 8, 10, 12 have a symmetrically spiral-cut groove 15 on the bottom side for the finger cylindrical retention pins 31 to nest. The scroll location plates 8, 10, 12 have a groove 26, to fit an O-ring 29 that facilitates the rotation of the scroll location plate 8, 10, 12 and holds fingers 34, 35, 36, 37, 38, 39, 40, 41 in place. The master sleeve 22 has an internal thread 23 to receive a threaded bolt 27 from the proximal end. A bolt extension 28 is available when needed. The bolt extension 28 contains an O-ring 43 to hold onto the threaded bolt 27. The distal end of the master sleeve 22 has an external thread 25 that screws into the master slotted disk 7, 9, 11 through the scroll location plate 8, 10, 12. With a step cut 24 above the threads, the scroll location plate 8, 10, 12 is allowed to turn left or right over the master slotted disk 7, 9, 11 by means of a non-threaded center hole 19.

Figure 5:
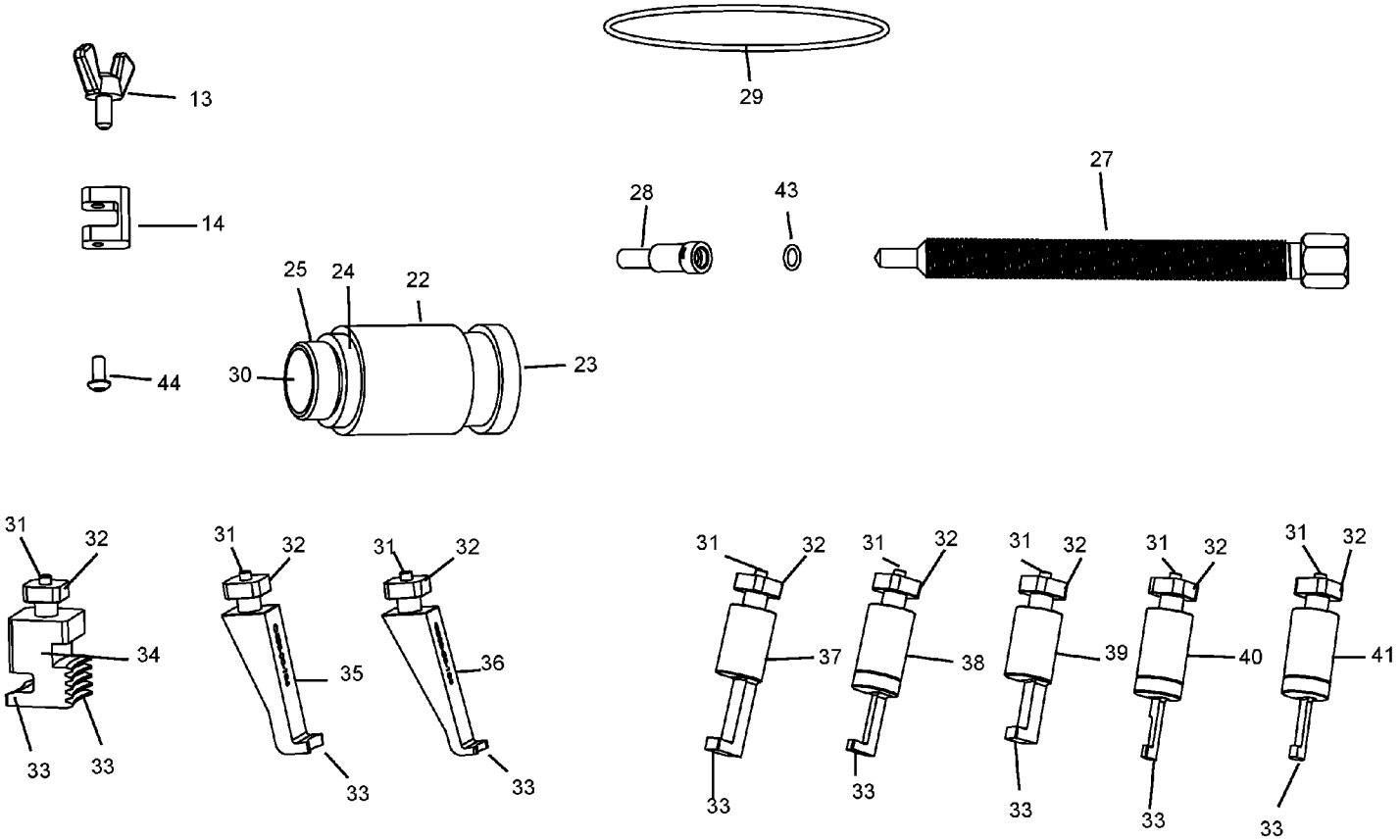
FIG. 5 is a view of fingers, master sleeve, bolt, bolt extension, U-shaped clamp, O-rings, screw, and wing screw
Figure 6:
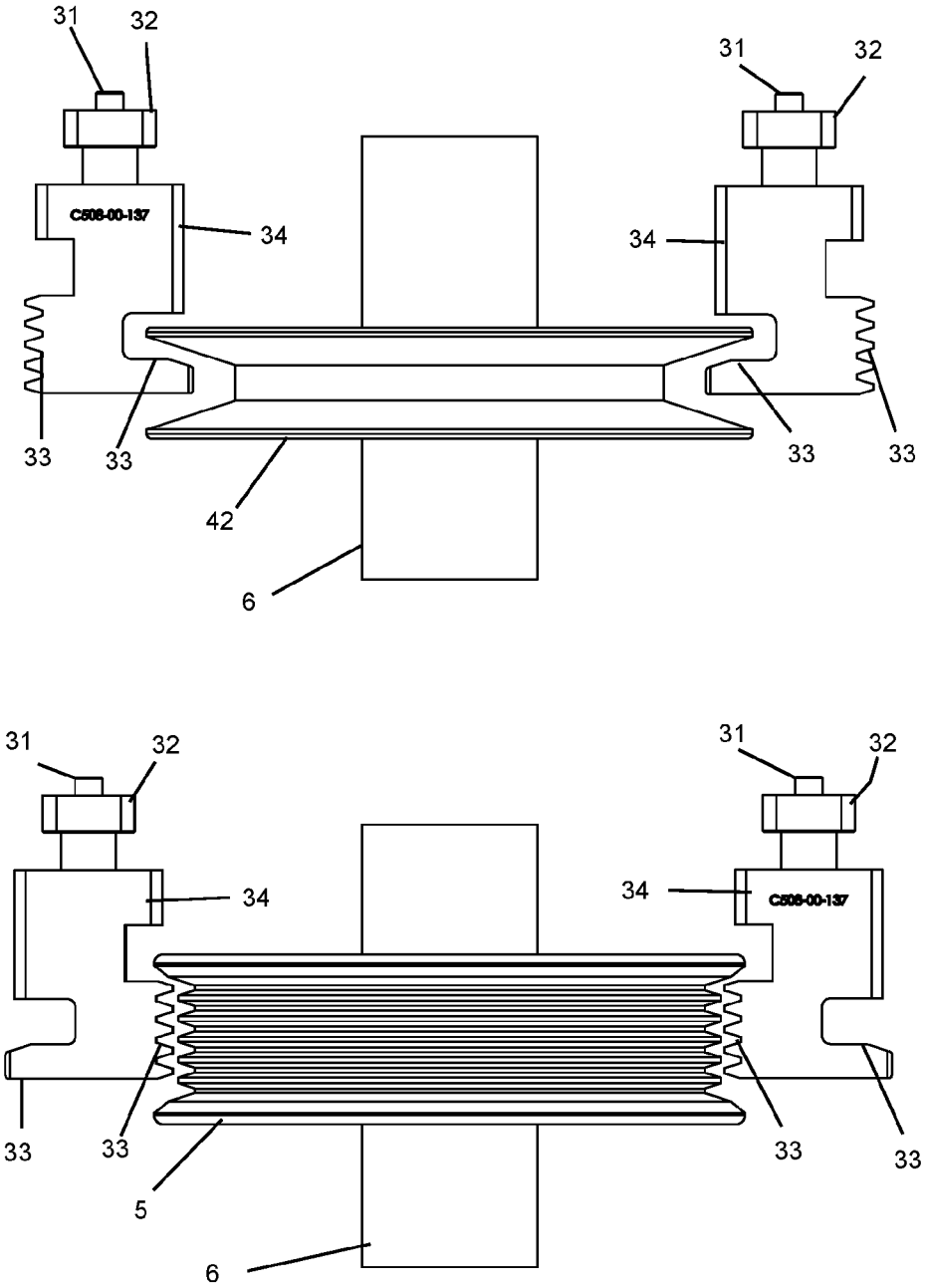
FIG. 6 is a view of fingers placed into a V-groove pulley and a serpentine pulley
Figure 7:
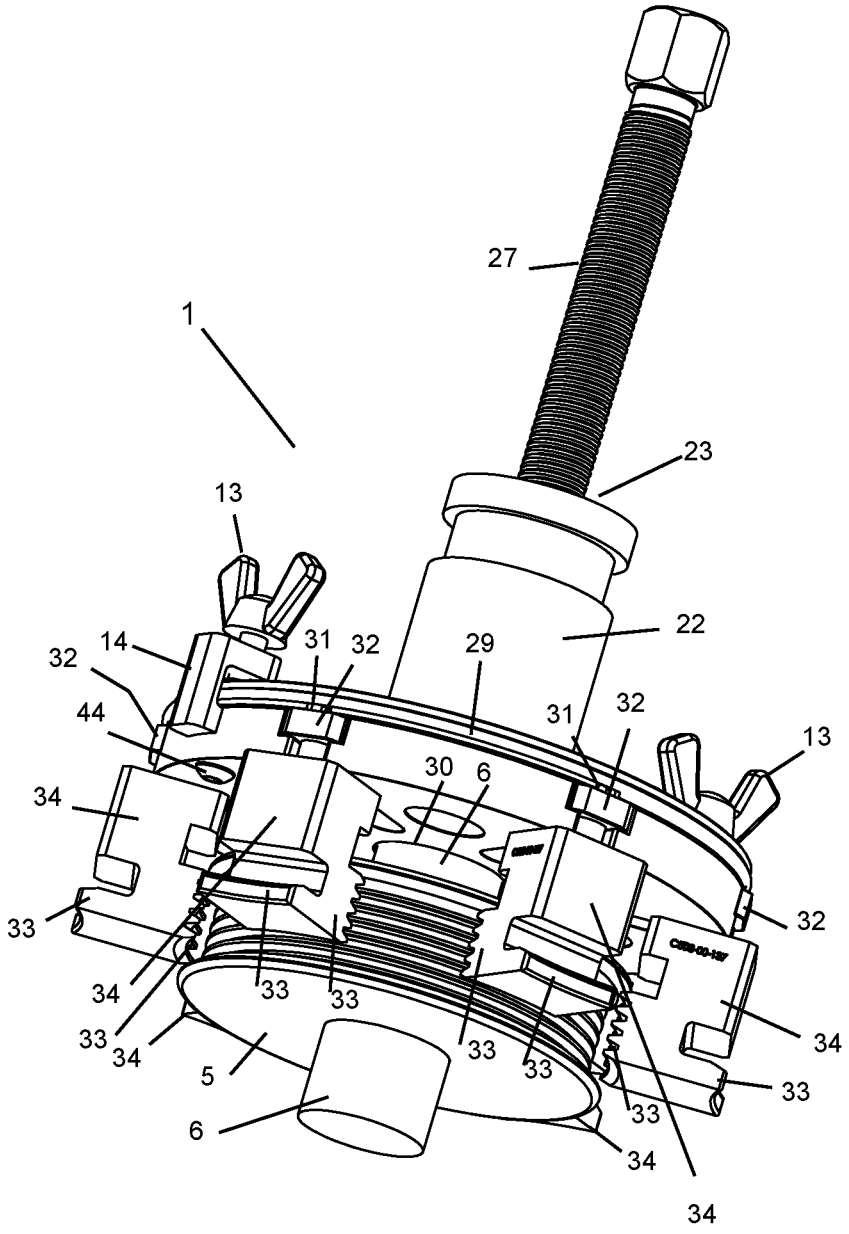
FIG. 7 is a view of the puller removing a pulley from the shaft

Referring to FIG. 5, this puller 1 has multiple types of fingers 34, 35, 36, 37, 38, 39, 40, 41, each with a cylindrical retention pin 31 positioned on the proximal end. All fingers 34, 35, 36, 37, 38, 39, 40, 41 are interchangeable with all three master slotted disks 7, 9, 11 and scroll location plates 8, 10, 12. The cylindrical retention pin 31 on the fingers 34, 35, 36, 37, 38, 39, 40, 41 fits into the symmetrically spiral-cut groove 15 on the bottom side of the scroll location plate 8, 10, 12. To install or replace fingers 34, 35, 36, 37, 38, 39, 40, 41, rotate the scroll location plate 8, 10, 12, to the right or left to align with the T-slots 18 of the master slotted disk 7, 9, 11, while simultaneously aligning with the opening of the symmetrically spiral-cut grooves 15, 16 of the scroll location plate. A four-slot master disk 7 with a matching scroll location plate 8, can be used to extract frames consisting of four or eight webs or holes. A five-slot master disk 9 with matching scroll location plate 10, is used in extraction of frames with five or ten webs or holes. A six-slot master disk 11 and matching scroll location plate 12 can be used for extractions in combinations of three or six webs or holes.

A variety of finger sets capable of a perpendicular diameter adjustment are available for multiple applications and extractions. Using a set of six fingers 34 for various-sized V-groove pulleys 42 enables the repair person to completely encompass the pulley to minimize damage during extraction. By rotating the same fingers 34 90 degrees, the repair person is now able to remove multiple groove serpentine pulleys 5. Another set of fingers 37, 38, 39, 40, 41, each with a unique flange 33, can be used to remove alternator frames with webs or holes in multiple diameters. Yet another set of fingers 36, can be used to pull bearings and similar objects.

What is claimed is:

1. A pulling tool comprising:

a hollow elongated cylindrical master sleeve having an outer diameter and two ends; the master sleeve comprising:

an interior threaded hole on a proximal end, a threaded first step cut at a distal end; a step cut defining a portion of reduced diameter relative to the outer diameter of the master sleeve;

a second step cut immediately proximal to the first step cut, the second step cut having a diameter greater than the first step cut, but less than the outer diameter of the master sleeve;

a third step cut disposed adjacent the proximal end of the master sleeve;

an elongated externally threaded screw member having a tapered point, the threaded screw member threadably received through the interior threaded hole of the master sleeve at the proximal end;

a scroll location plate having a non-threaded center bore and symmetrically spiral-cut grooves on a lower face of the scroll location plate;

a master slotted disk with a threaded center bore and a plurality of T-slots extending in a radial direction, cut completely through a thickness of the master slotted disk; and a plurality of fingers, each of the plurality of fingers having a pin at a respective proximal end, each of the pins disposed in a corresponding spiral-cut groove;

wherein the threaded first step cut is releasably connected through the non-threaded center bore of the scroll location plate and into the threaded center bore of the master slotted disk, such that the second step cut engages the non-threaded center bore of the scroll location plate; and such that the scroll location plate is in stacked orientation with the master slotted disk.

2. The pulling tool of claim 1, wherein the plurality of T-slots are stepped slots having a width on an upper face of the master slotted disk greater than a width on a lower face of a the master slotted disk;

wherein each of the plurality of T-slots is configured to receive a respective finger and is configured to allow each of the respective fingers to move radially inwardly and outwardly; the tool further comprising a U-shaped clamp that rigidly connects the master slotted disk to the scroll location plate via a threaded member, such that the lower face of the scroll location plate directly opposes the upper face of the master slotted disk.

3. The pulling tool of claim 2, wherein the spiral-cut grooves extend symmetrically about a center point, such that relative translation of each respective pin in a corresponding spiral-cut groove provides for radial inward and outward movement of each of the respective fingers;

wherein the scroll location plate and the master slotted disk are rotatable relative to the master sleeve, and aligning outer portions of the spiral-cut grooves with respective outer portions of the plurality of T-slots allows for finger installation;

wherein the scroll location plate is configured to rotate about the master sleeve via the non-threaded center bore of the scroll location plate.

4. The pulling tool of claim 3, wherein each of the fingers further comprises a guide disposed immediately adjacent each respective pin, each of the guides comprising a generally square shape and configured to be selectively received in a respective slot of the upper face of the master slotted disk in one of four orientations, allowing each finger to be disposed radially inwardly, or radially outwardly, or in one of two circumferential directions, relative to the master slotted disk; such that the fingers are configured to move radially inwardly or radially outwardly relative to the master slotted disk upon rotation of the scroll location plate.

5. The pulling tool of claim 4, wherein each finger has first and second opposing sides, each opposing side having a longitudinally concave surface; each of the first opposing sides comprising a plurality of grooves configured to engage a serpentine belt pulley, and each of the second opposing sides comprising a recess configured to engage a V-belt pulley.

* * * * *